United States Patent [19]

Woodson

[11] Patent Number: 4,479,653

[45] Date of Patent: Oct. 30, 1984

[54] GOLF SWING TRAINER

[76] Inventor: Leland B. Woodson, 314 E. 12th, Hutchinson, Kans. 67501

[21] Appl. No.: 501,823

[22] Filed: Jun. 7, 1983

[51] Int. Cl.[3] ..... A63B 69/36

[52] U.S. Cl. ..... 273/183 B; 273/186 A; 273/186 C; 273/191 B; 273/193 B

[58] Field of Search ..... 273/188 R, 188 A, 190 R, 273/190 A, 190 B, 190 C, 191 B, 191 R, 191 A, 186 R, 186 A, 186 C, 193 R, 193 A, 193 B, 183 B

[56] References Cited

U.S. PATENT DOCUMENTS

| | | | |
|---|---|---|---|
| 2,103,502 | 12/1937 | Webster | 273/191 B |
| 3,229,980 | 1/1966 | Silberman | 273/186 A |
| 3,595,583 | 7/1971 | Oppenheimer | 273/191 B |
| 4,181,310 | 1/1980 | Boehmer | 273/191 B |

*Primary Examiner*—George J. Marlo
*Attorney, Agent, or Firm*—Robert E. Breidenthal

[57] ABSTRACT

Golfer training apparatus wherein a base is adapted to be strapped to the user at a position in the vicinity of where he positions his hands when addressing the ball. An elongated handle guide has one end secured to the base by a ball and socket joint, such guide being flexible and resilient with an elongated tubular member that simulates a golf club handle being slidable on the guide so that the user's hands are subjected to forces due to the coaction of the handle on the flexible and resilient handle guide that can be readily learned to correspond to a proper back swing and follow through, while virtually preventing the golfer from rearing up. The position of the ball and socket joint is adjustable and the same can be readily disassembled.

10 Claims, 6 Drawing Figures

GOLF SWING TRAINER

The present invention relates to new and useful improvements in golfer training apparatus and more particularly pertains to such apparatus that enables the user to "groove" or repitiously execute a proper swing and especially that part of the swing immediately prior to and following impacting the ball that is commonly susceptible to the golfer's error of rearing up.

The paramount object is to provide a training apparatus appropriate to and effective with respect to all aspects of a golfer's swing including all aspects of addressing the ball, the backswing, the ball impact phase of the swing, and the complete follow through.

Another important object of the invention in accordance with the preceding object is to subject the user's hands to forces throughout all phases of the swing that can be readily learned by the user in relation to those experienced during a properly executed swing to the end that the user can speedily and efficaciously "groove" his proper swing.

Another final important object of be specifically set forth in accordance with the preceding object is to provide apparatus that virtually precludes the user from rearing up immediately prior to and immediately following the moment of ball impact.

These and other objects as well as the means of their realization will become readily apparent in the light of the ensuing description of a preferred embodiment of the invention, such description being given in conjunction with the accompanying drawings, wherein.

Figure 1:
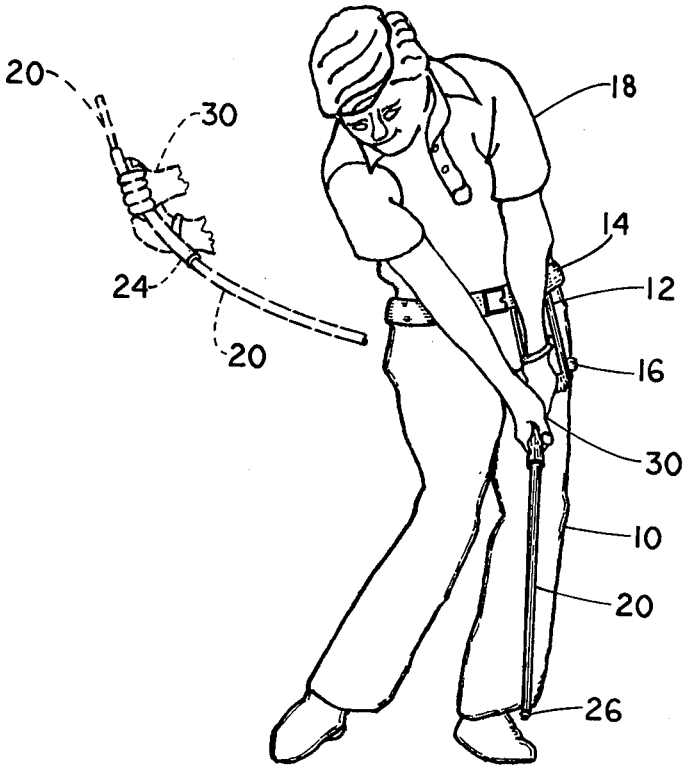
FIG. 1 is a front view of a golfer utilizing the apparatus of the invention, the view illustrating in full lines the ball impact phase of a practice swing, and showing in dashed lines an intermediate position of a backswing to illustrate resilient flexure of the handle guide means.

Referring now the drawings wherein like numerals designate like parts throughout the various views, the reference numeral 10 designates the golfer training apparatus generally, such apparatus 10 being principally comprised of a base 12 adapted by waist and leg straps 14 and 16, respectively, for detachable securance to a golfer designated generally at 18. An elongated handle guide means 20 is swivelly connected at one end to the base 12 by a ball-and-socket joint designated generally at 22, and a tubular simulated golf club handle indicated at 24 is slidably and guidingly disposed on the guide means 20. The end of the guide means 20 remote from the joint 22 is provided with a radial enlargement 26 for preventing inadvertent removal of the handle 24 at such end of the guide means 20.

The guide means 20 is of cylindrical, preferably circular, transverse configuration intermediate the joint 22 and the enlargement or stop 26. Such cylindrical extent of the guide means 20 is flexible and resilient and is preferably of varying stiffness along its extent in that the stiffness diminishes progressively from the joint 22 to the stop 26 for reasons that will presently manifest themselves.

The handle guide means 20 can be made of metal with the variation in stiffness being obtained by varying the degree or amount of tempering to which the metal is subjected along its extent in accordance with practices well known in the metallurgical arts.

If desired, the handle guide means 20 can be fabricated of any suitably resilient synthetic resin with desired varying stiffness being realized by incorporating a reinforcing and stiffening agent, such as fibers of glass or woven glass fibers in the resin in varying amounts along the extent of the guide means 20. A guide means 20 of the desired physical properties and overall dimensions can be obtained by making it of composite character such as by providing a tapered metal spring rod and encasing the latter in a plastic sheath having a cylindrical configuration by molding. For example, nylon or polyetheline can be molded about a tapered spring steel rod.

The elongated tubular handle 24, which can conveniently be of any suitable synethetic resin, has a length suitable to accommodate the gripping hands 30 of the golfer 18 and has an external shape and finish to simulate a convention gripping or handle portion of a golf club or driver as indicated at 32.

The handle 24 has a cylindrical opening 34 therethrough that may be lined with a sleeve 36 of a well known tetrafluorethylene resin to minimize friction in a sliding fit on the correspondingly cylindrical guide 20. It will become obvious that the handle 24 is placed on the guide rod or guide means 20 prior to fixing the stop 26 on the rod 20.

The base 12 comprises an elongated metal or stiff leather plate 40 provided with pairs of slots 42 and 44 at its upper and lower ends for accommodating the leather or plastic belts or straps 14 and 16. The belts are provided with conventional buckles 46 and 48 and openings 50 and 52 for adjustable securance about the waist and upper thigh of a user. The plate 40 may have a soft rear layer, not shown, and is adapted to seat against the person of the user as indicated in FIG. 1. It will be evident that the side of the plate 40 contacting the user 18 can be padded if desired.

Figure 3:
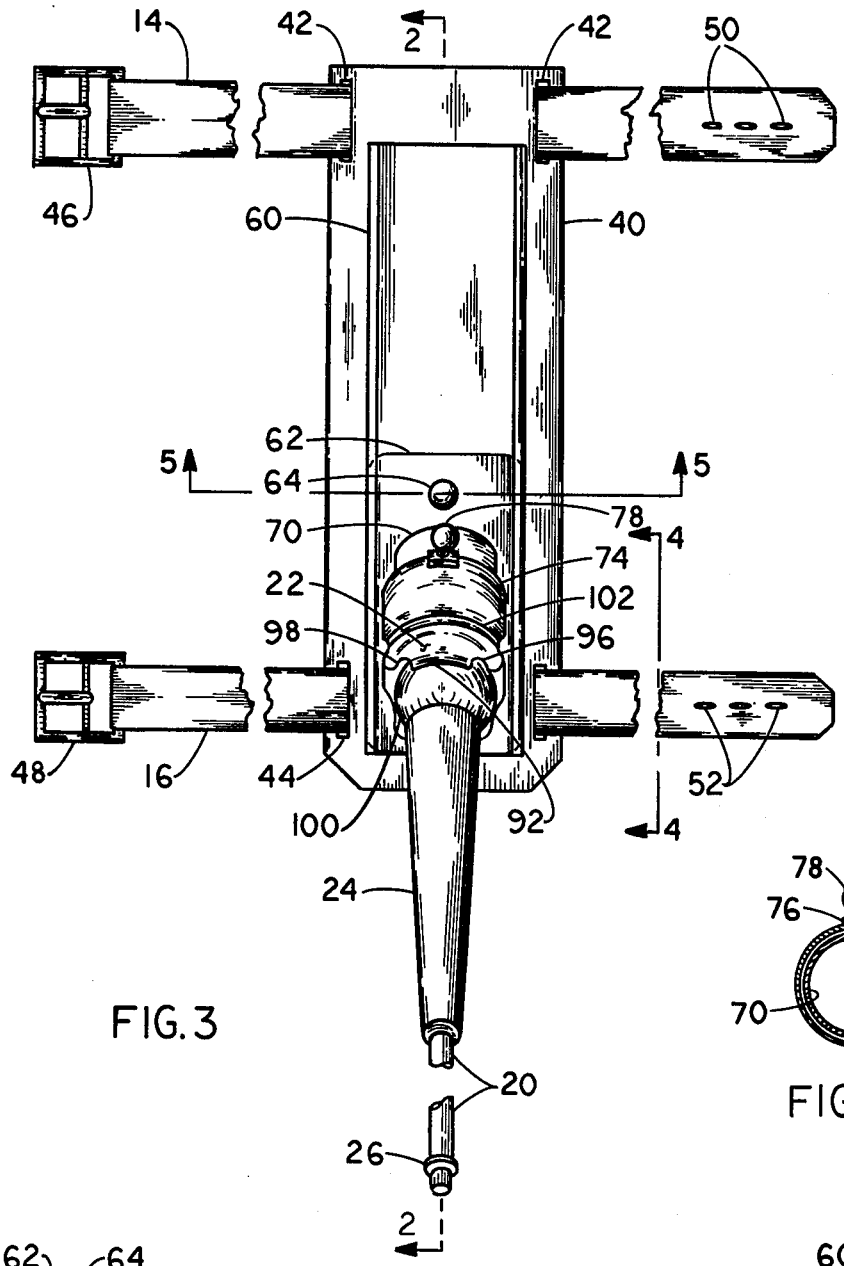
FIG. 3 is a broken front view of the training apparatus.
Figure 6:
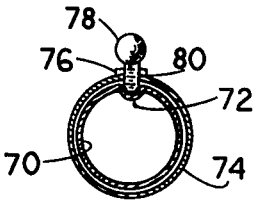
Figure 5:
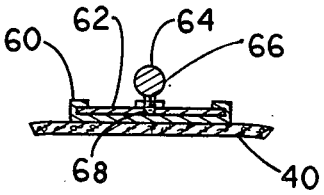
FIG. 5 is a sectional detail view taken upon the plane of the section line 5—5 in FIG. 3; and, FIG. 6 is a transverse sectional detail view taken upon the plane of the section line 6—6 in FIG. 2.

An elongated metal channel 60 is fixed to the plate 40 as shown in FIGS. 3 and 5 and serves as a guide for a flat metal slide 62 slidable therein. The slide 62 is secured in adjusted relation along the vertical extent of the channel 60 by means of a finger screw 64 threaded through an internally threaded nut 66 welded to the slide 62 so as to bear, when tightened, against the channel 60 through an opening 68 in the slide 62.

Figure 2:
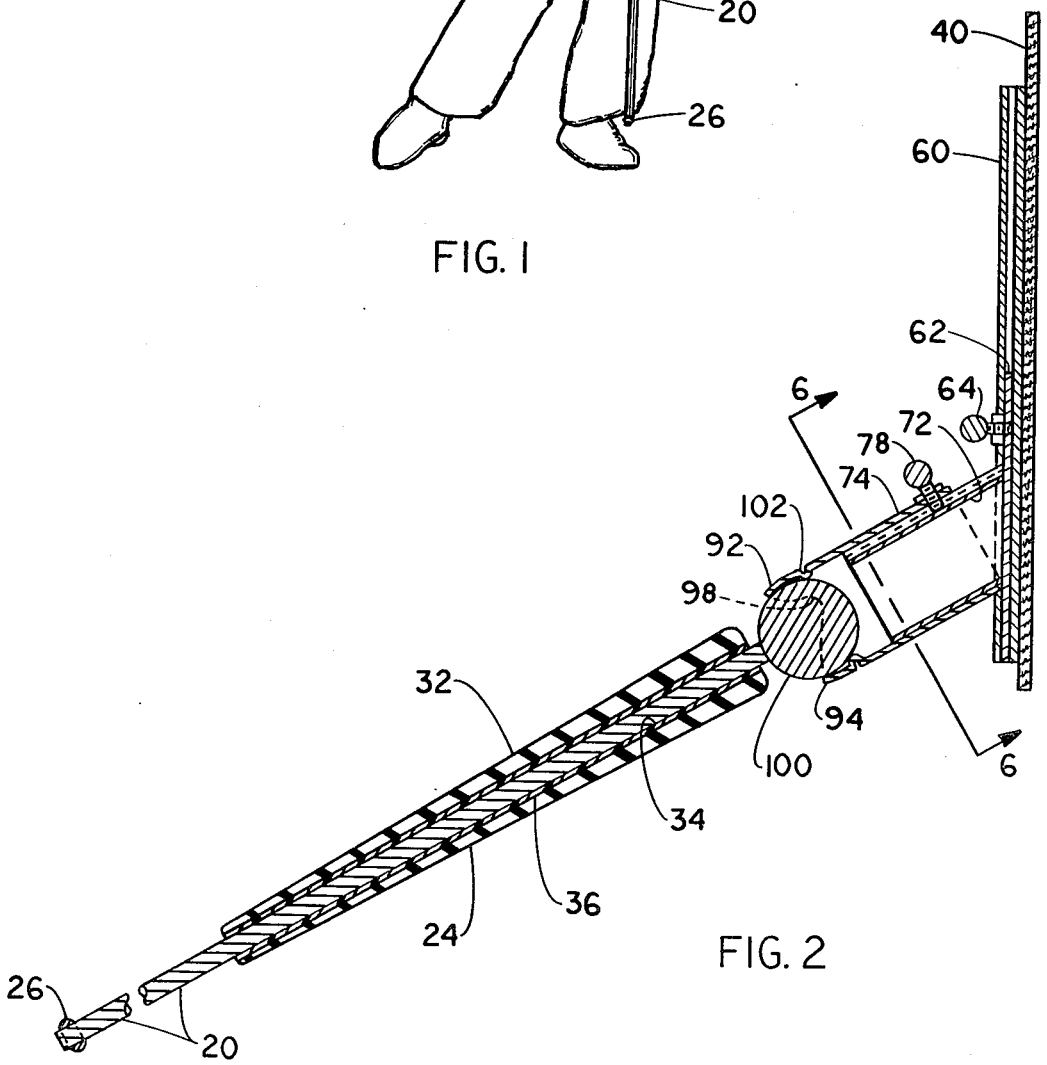
FIG. 2 is an enlarged and broken vertical sectional view of the training apparatus taken upon the plane of the section line 2—2 in FIG. 3, with hidden details being shown in dashed lines.

A downwardly inclined tube 70 has its upper end fixed or welded to the slide 62, and such tube has a crease or indentation 72 formed in its upper side that extends the entire length of the tube 70. A second tube or tubular member 74 is slidably disposed on the tube 70 in a telescoping arrangement as clearly shown in FIG. 2. An internally threaded nut 76 is welded to the top of the tube 74, and a finger screw 78 threads through the nut and an aligned opening 80 in the tube 74 to be received in the crease or groove defined by the indentation 72 in the tube 70. The arrangement is such that when the screw 76 is tightened it secures the tubes 70 and 74 in adjusted telescoping relation. When the screw 76 is loosened sufficiently to allow telescoping movement, the lower end of the screw 76 rides in the groove and prevents rotation of the outer tube 74. Indeed, the latter mentioned relationship assures convenient assembly of the tubes 70 and 74 with the latter being oriented as shown in the drawings.

As thus far described, it will be evident that the user 18 can, by use of the finger screws 64 and 78, efficaciously adjust the vertical height of and the spacing of the tube 74 with respect to the base plate 40.

As now will be explained, the end of the tube 74 remote from the plate 40 constitutes a socket portion 90 of the ball-and-socket joint 22.

The upper and lower marginal end edges of the free end of the tube 74 are inturned slightly to constitute upper and lower ball retaining lips 92 and 94, with such lips being circumferentially spaced from each other by notches 96 and 98 in the end of the tube 74. As clearly shown in the drawings, the notches 96 and 98 ahve a vertical plane of symmetry (as does the apparatus 10 generally, excepting the straps 14 and 16), and have smoothly rounded boundaries that are canted upwardly and rearwardly for a purpose that will become manifest.

It is to be noted that the tube 74 is preferably metal and is preferably resilient so that a ball 100 fixed to the guide rod or means 20 can be forced into the tube 74 between the lips 92 and 94 which resiliently yield to allow passage of the ball 100 therebetween. The use of spaced resilient lips facilitates such passage of the ball 100 therebetween. It will be understood that the ball 100 will normally be retained in the tube 74 by sliding engagement of the lips 92 and 94 on the ball 100.

The lips 92 and 94 engage the ball 100 with sufficient force to prevent inadvertent removal of the ball 100 during use of the apparatus 10, but will allow forceful withdrawal of the ball 100 when desired.

The penetration of the ball 100 into the tube is limited by the tube 74 being provided with a circumferential crease or internal constriction 102 in the tube 74. The internal diameter of the tube 74 is such and the axial spacing of the crease 102 is such that the ball 100 is slidably engaged by the inside of the tube and is denied any appreciable axial movement in the tube 74 by sliding engagement with the constriction 102 and the lips 92 and 94.

The use of the apparatus 10 will be readily understood. The symmetry of the apparatus 10 allows its use by both left- and right-handed persons. Assuming the user 18 to be right-handed as shown, the base 12 is detachably secured to the user at a position above the front of the left thigh by securing the strap 14 about the waist and securing the strap 16 about the upper portion of the left leg. It will be apparent that the base 12 can be secured to both males and females alike as the shorts or short skirts commonly worn by females enable such attachment without difficulty. It is important to note that the attached base 12 does not interfere with the walking of the user or otherwise subject the user to any discomfort, and indeed the user may elect to leave the base 12 attached during intervals between practice sessions.

Figure 4:
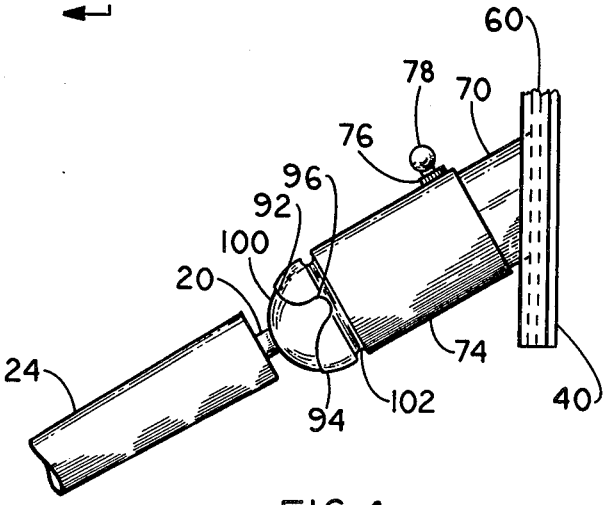
FIG. 4 is an enlarged fragmentary side view of the ball and socket joint, the view being taken from the plane of the section line 4—4 in FIG. 3.

With the base 12 attached, the user 18 forcibly inserts the ball 100 into the socket defining portion of the tube 74, and may then assume a customary stance employed with respect to a golf ball, not shown, placed on the ground while gripping the handle 24. Appropriate adjustment of the slide 62 in the channel 60 and of the tube 74 on the tube 70 will serve to position the handle 24 closely adjacent the ball 100 as shown in FIG. 4 when the golf ball is properly addressed. Considering the end of the rod or guide means 20 immediately adjacent the ball 100 to be a constrained end of the guide means 20 (the ball-and-socket joint 22 constituting the constraint on such end of the rod 20), such adjustment and stance when addressing the ball virtually prohibits the user 18 from rearing up while gripping the handle 24.

The user 18 may then execute the movements associated with a proper backswing (initially under the tutelage of an instructor) and become accustomed to the forces experienced by his gripping hands 30 resulting from coaction between the resiliently flexing rod 20 and the handle 24.

FIG. 1 illustrates in dashed outline an intermediate position during the backswing and serves to show a modest degree of flexure of the rod 20 between the handle 24 and the base 12 which, of course, subjects his hands 30 to forces that can be remembered by the user 18 to be appropriate to the illustrated portion of the backswing. It will be evident that at the greatest extent of the backswing that much greater flexure of the rod 20 will occur and such is readily accommodated by the decreased stiffness of the outer end portion of the rod 20.

In a similar manner the user 18, preferably under the tutelage of a skilled instructor will become acquainted with the proper feel of the handle 24 throughout all phases of a proper swing inclusive of the backswing, the power swing and the complete follow-through. Having become familiarized with the proper feel of the handle 24 throughout a properly executed swing, the user 18 can progressively increase the speed of execution of his swing while executing the swing for a sufficient number of times to "groove" his swing. It is desirable that the user 18 alternate user of the apparatus 10 with actually driving balls during an extended practice session so as to further correlate his learning experience with the apparatus 10 with actual ball driving experience.

It is again stressed that inasmuch as the simulated handle 24 approaches the constrained end of the rod 20 as the rod 20 moves into its simulated ball impacting phase, the gripping hands 30 must also pass closely adjacent the ball-and-socket joint 22 so as to restrain to a marked degree any tendency of the user 18 to rear up at such critical phase of a swing. Thus, the user 18 may avoid or break any habit of raising his head when the ball is struck.

The notches 96 and 98, which are upwardly and rearwardly directed as shown, serve to allow the greater degree of relative movement of the rod 20 required by the backswing and the follow-through phases of the swing; however, the depth of such notches are such that they act as stops so that the rod 20 is forced to flex and form an arc as the hands of the user approach their extreme positions at the extremities of the swing. Such arcing of the rod 20 on the latter encountering the end of a notch as the handle 24 approaches the free end of the rod 20 is accompanied by the handle 24 being turned or oriented so as to be in accordance with the appropriate "breaking" of the user's wrists at the extremes of the swing as will be appreciated. The extent of such breaking of the swists is enhanced by the relatively greater flexibility of the rod 20 in its extent adjacent its free end.

Having fully described the invention and the manner of its use, attention is now directed to the appended claims in order to ascertain the actual scope of the invention.

I claim:

1. Golfer swing training apparatus comprising an elongated handle guide means having a free end and constrained end, said guide means being flexible and resilient, a base and coacting means carried by the base and the constrained end of the guide means for constraining the constrained end of the guide means to a position substantially fixed relative to the base while enabling an assentially swinging movement of the guide means about the coacting means as an apex, a simulated and elongated golf club handle of substantially lesser length than the guide means, said handle being operatively mounted on the guide means for guidance along the extent of the latter, with the handle and guide means coacting in such a manner that the extent of the handle remains essentially parallel to the extent of the guide means immediately adjacent thereto, said base being adapted to bear against the person of a user, and said base being provided with means enabling its detachable securance to the person of the user, the arrangement being such that a user may grip the simulated handle when the latter is adjacent the constrained end of the guide means while assuming a stance customary on addressing a golf ball, whereupon all subsequent manipulations of the handle by the user during a simulated backswing and ensuing follow through subject the user's handle gripping hands to forces resulting from coaction of the resiliently flexing guide means and the handle that enable the user quickly to sense departures from a desired mode of swing, while virtually compelling the handle to travel a swing path inconsistent with the user rearing up as the handle approaches and departs from the immediate vicinity of the constrained end of the guide means.

2. The combination of claim 1, wherein the coacting means limits the freedom of swinging movement of the guide means to a non-conical spatial angle.

3. The combination of claim 1, including means enabling change of position of the coacting means relative to the base, together with means for releasably securing the coacting means in a selected position relative to the base.

4. The combination of claim 1, wherein the coacting means includes separable portions carried by the guide means and the base, and means for detachably securing the separable portions together in operative condition.

5. The combination of claim 1, wherein the coacting means is of a ball-and-socket joint type.

6. The combination of claim 5, wherein the constrained end of the guide means constitutes the ball portion of the ball-and-socket type joint, with the socket portion of the joint being carried by the base.

7. The combination of claim 6, wherein the socket portion of the joint comprises a tubular member having a ball receiving end, said tubular member having an internal constriction spaced from the ball receiving end for limiting the insertion of the ball portion thereinto, and said tubular member having an inturned lip at its ball receiving end that slidingly engages the ball portion for retaining the ball portion in sliding engagement with said internal constriction.

8. The combination of claim 7, wherein the lip is resilient and dimensioned relative to the ball portion so that the latter can be pulled from and pushed into its operative position within the socket portion, whereby the base and the guide means can be separated for storage and transport, and whereby the user may be temporarily freed of the guide means without detaching the base from his person.

9. The combination of claim 7, wherein the lip is peripherally discontinuous and constituted of at least two lip portions that are circumferentially spaced from each other, said ball portion being radially enlarged relative to the guide means, with at least one of the spacings between lips being defined by the tubular member having notches therein that enable a greater degree of swinging movement of the guide means in selected directions.

10. The combination of claim 1, wherein the guide means is of relatively less resilient stiffness adjacent its free end as compared to adjacent its constrained end.

* * * * *